US012642361B2

(12) United States Patent
Kroon

(10) Patent No.: US 12,642,361 B2
(45) Date of Patent: Jun. 2, 2026

(54) MATTRESS SPRING CORE

(71) Applicant: Inter IKEA Systems B.V., Delft (NL)

(72) Inventor: Johan Kroon, Höör (SE)

(73) Assignee: Inter IKEA Systems B.V., Delft (NL)

( * ) Notice: Subject to any disclaimer, the term of this patent is extended or adjusted under 35 U.S.C. 154(b) by 75 days.

(21) Appl. No.: 18/273,608

(22) PCT Filed: Jan. 21, 2022

(86) PCT No.: PCT/SE2022/050063
§ 371 (c)(1),
(2) Date: Jul. 21, 2023

(87) PCT Pub. No.: WO2022/159024
PCT Pub. Date: Jul. 28, 2022

(65) Prior Publication Data

US 2024/0298810 A1 Sep. 12, 2024

(30) Foreign Application Priority Data

Jan. 22, 2021 (SE) ..... 2150066-5

(51) Int. Cl.
*A47C 27/045* (2006.01)
*A47C 27/05* (2006.01)
*A47C 27/06* (2006.01)

(52) U.S. Cl.
CPC ..... *A47C 27/0456* (2013.01); *A47C 27/0453* (2013.01); *A47C 27/053* (2013.01); *A47C 27/064* (2013.01)

(58) Field of Classification Search
CPC ..... A47C 27/064; A47C 27/07; A47C 27/05; A47C 27/056; A47C 27/053; A47C 27/15;
(Continued)

(56) References Cited

U.S. PATENT DOCUMENTS 4,648,186 A * 3/1987 Dolman ..... F26B 5/16 34/95
5,040,255 A * 8/1991 Barber, Jr. ..... A47C 27/063 5/718
(Continued)

FOREIGN PATENT DOCUMENTS

CN 101448435 A 6/2009
EP 0052389 A1 5/1982
(Continued)

OTHER PUBLICATIONS

Extended European Search Report and Search Opinion received for EP Application No. 22742955.2, mailed on Nov. 15, 2024, 7 pages.
(Continued)

*Primary Examiner* — Brian D Mattei
(74) *Attorney, Agent, or Firm* — Dilworth IP, LLC

(57) ABSTRACT

A mattress spring core including a sheet and a plurality of spring core units arranged on the sheet. The spring core units are arranged in longitudinal strings, the strings being attached to the sheet side by side to form a rectangular shaped mattress spring core. The sheet is configured to stabilize the rectangular shape of the mattress spring core by preventing the spring core units of a first string to be displaced relative the spring core units of an adjacent string.

16 Claims, 6 Drawing Sheets

(58) Field of Classification Search
CPC ..... A47C 27/06; A47C 27/062; A47C 27/063; A47C 27/066; A47C 27/04; A47C 27/0456; A47C 27/0453; A47C 27/045
See application file for complete search history.

(56) References Cited

U.S. PATENT DOCUMENTS 5,674,336 A * 10/1997 Coe ..... E04D 7/00 156/305
6,159,574 A * 12/2000 Landvik ..... B32B 5/32 428/218
8,791,321 B2 * 7/2014 Love ..... A61F 13/53 5/81.1 R
2002/0029424 A1 * 3/2002 Balsavich ..... A47C 23/30 5/720
2004/0133988 A1 7/2004 Barber
2005/0084667 A1 * 4/2005 Landvik ..... B32B 5/18 428/218
2008/0206513 A1 * 8/2008 Malz ..... D06N 7/0076 428/95
2009/0188091 A1 * 7/2009 Van Kerrebrouck ..... D04H 1/5412 28/112
2009/0258559 A1 * 10/2009 Anantharamaiah ..... D04H 1/74 442/334
2009/0288258 A1 * 11/2009 Grothaus ..... A47C 27/066 5/717
2011/0173757 A1 * 7/2011 Rensink ..... A47C 27/15 5/655.5
2012/0060286 A1 * 3/2012 Gendron ..... A47C 27/007 5/500
2012/0244312 A1 * 9/2012 Pearce ..... D06N 7/0092 428/196
2015/0313371 A1 11/2015 Ahlqvist
2016/0174725 A1 * 6/2016 Takaoka ..... A47C 27/006 5/652.1
2018/0105965 A1 * 4/2018 Pourdeyhimi ..... D04H 1/492
2019/0183253 A1 6/2019 Codos
2019/0357694 A1 * 11/2019 Jewett ..... A47C 7/35
2020/0080241 A1 * 3/2020 Ray ..... D03D 1/00
2020/0085205 A1 * 3/2020 Moore, III ..... A47C 31/001
2021/0251391 A1 * 8/2021 Wagner ..... B65D 75/002
2023/0235484 A1 * 7/2023 Edwards ..... A41D 31/065 442/334
2024/0008655 A1 * 1/2024 Jewett ..... B68G 7/02
2025/0107632 A1 * 4/2025 Armatys ..... A47C 27/064

FOREIGN PATENT DOCUMENTS

JP 05-011803 Y2 3/1993
WO 2018206249 A1 11/2018

OTHER PUBLICATIONS

International Search Report and Written Opinion received for PCT Patent Application No. PCT/SE2022/050063, mailed on Feb. 1, 2022, 11 pages.
Office Action received for Chinese Patent Application No. 202280010868.2, mailed on Nov. 25, 2025, 18 pages (11 pages of English Translation and 7 pages of Original Document).

* cited by examiner

MATTRESS SPRING CORE

TECHNICAL FIELD

The present invention relates to a mattress spring core, and more specifically to improvements for stabilizing the shape and size of such mattress spring core.

BACKGROUND

Spring core mattresses are a common type of mattresses, where, most often, coil springs are arranged in fabric pockets to form elongated strings comprising a plurality of interconnected spring pockets. The strings are arranged side by side thereby providing a mattress with individual springs being kept in position by the fabric pockets normally being made of a nonwoven material. As the techniques for manufacturing mattresses improve, customers have come to expect ever improving performance from new mattresses which are made available on the market. For instance, mattresses are available with zones having varying stiffness to suit the needs of different users.

To reduce mattress deformation during use of the mattress, mattresses are often produced by a large number of spring pockets so that each spring pocket forms a support for its neighbouring pockets.

To provide an improved sense of stability and further reduce deformation of the mattress, mattresses are commonly designed with a rectangular frame or other type of reinforcement around the edges of the mattress. One known example of such frames is for instance a foam box construction, where a polyurethane frame is used to reinforce the edges. Another example is a steel rod being bent to form the frame.

A drawback with a large number of spring pockets is that it is costly as it requires a vast amount of material as well as increasing production time.

A drawback with the foam box construction and the steel frame construction is that both of them require manual handling in the production, which makes them costly.

To reduce cost during transport and storage of the mattress, it is preferred that the mattresses can be vacuum pressed. To further reduce cost, it is also preferred that the vacuum pressed mattress can be rolled up. Thereby each mattress will require much less space during transport and storage, before it reaches the customers. However, especially when producing mattresses with the above-mentioned steel frame, the mattress cannot be vacuum pressed and rolled up for storage and transport without damaging the frame.

An alternative to the prior art solutions is therefore sought after, which provides improved performance at a lower cost. Especially, it is desired to find a solution which allows for a mattress which allows for vacuum and roll packaging, which allows for a reduced number of springs, and which reduces manual labour.

SUMMARY OF THE INVENTION

In view of the above, an object of the teachings herein is to solve or at least reduce the above stated problems.

According to a first aspect, a mattress spring core is provided. The mattress spring core comprises a sheet and a plurality of spring core units arranged on the sheet. The spring core units are arranged in longitudinal strings, said strings being attached to the sheet side by side to form a rectangular shaped mattress spring core. The sheet is configured to stabilize the rectangular shape of the mattress spring core by preventing the spring core units of a first string to be displaced relative the spring core units of an adjacent string.

The spring core units may be attached directly onto the sheet, or an intermediate layer of e.g. a non-woven deck fabric may be arranged between the sheet and the spring core units.

The term "displaced" should in this context be interpreted with regards to the purpose of the sheet, i.e. to maintain the desired rectangular shape of the mattress spring core. As an example, a spring core unit may be allowed to move slightly relative adjacent spring core units without being considered to be displaced, as long as the general rectangular shape of the mattress spring core is maintained. Further, spring core units may be allowed to tilt slightly relative their intended vertical axis, such as their upper ends are moved relative each other, although the sheet maintains the rectangular shape of the bottom part of the mattress spring core. Also in such case, the spring core units are not displaced within the meaning herein.

The sheet may be a non-woven fabric, which will provide improved dimension stability.

The sheet may be made of felt.

The sheet may be made of a polymer, preferably polyester.

The density of the sheet material may be between 300 and 1000 g/m2, preferably in the range of 600 g/m2±20%.

Preferably, the sheet is formed by a bicomponent fiber comprising polyester and a plastic material.

The sheet may have a tensile strength in the machine direction of at least 700 N, preferably at least 850 N.

The sheet may have a tensile strength in the cross direction of at least 900 N, preferably at least 1100 N.

The sheet may have a thickness of 2-6 mm, preferably in the range of 4 mm±1 mm.

The strings may be attached to the sheet by means of an adhesive or by means of one or more fasteners.

In one embodiment, at least one spring core unit of a string is attached to the sheet. Attaching the string by attaching only one or a few of the spring core units to the sheet will reduce the time required to produce the mattress spring core. This may be particularly advantageous if the strings are manually attached to the sheet.

In one embodiment, at least the first and last spring core units of a string are attached to the sheet. This will ensure that the string has no loose ends. In the case when the length of the string corresponds to the longitudinal length or the transvers length of the mattress spring core, attaching the first and last spring core unit to the sheet will further help to stabilize the rectangular shape of the mattress spring core.

The mattress spring core may further comprise a foam cover being arranged on top of the spring core units such that the spring core units are arranged in between the sheet and the foam cover, wherein the foam cover is configured to further stabilizing the rectangular shape of the mattress spring core.

According to a second aspect, a mattress comprising the mattress spring core of the first aspect is provided.

According to a third aspect, a method for producing a mattress spring core is provided. The method comprises providing a sheet, providing a plurality of spring core units arranged in longitudinal strings, and attaching said strings to the sheet side by side to form a rectangular shaped mattress spring core. The sheet is configured to stabilize the rectangular shape of the mattress spring core by preventing the spring core units of a first string to be displaced relative the spring core units of an adjacent string.

According to further aspects of the invention the technical solutions according to the first, second, and third aspects described above are combined with the concept of providing the mattress spring core, comprising a plurality of spring pockets arranged in longitudinal columns and transverse rows, with at least one corner spring pocket projecting longitudinally from an adjacent column end spring pocket.

Preferably the longitudinal columns are extending in the intended head-to-toe direction of a person using the mattress. The spring pockets may be arranged in a plurality of parallel central spring strings forming a rectangular central part, and in at least two outermost spring strings arranged on opposite sides of the central spring strings. Preferably, the outermost spring strings are arranged immediately next to the rectangular central part. Further, it is preferred that the central spring strings of the rectangular central part all have the same length and/or the same number of spring pockets.

At least one of the outermost spring strings is longitudinally displaced relative the central spring strings. This provides an efficient means for ensuring the longitudinal projection of the corner spring pocket. Preferably, each outermost spring string comprises one additional spring pocket as compared to the central spring strings. In such embodiment each end spring pocket of the outermost spring string will protrude longitudinally by half a spring pocket from the end spring pockets of the central spring strings.

A width of the spring pockets of the outermost spring string may be smaller or greater than the width of the spring pockets in a central spring string. Different firmness of different areas of the mattress may thus be achieved.

The spring strings may be attached to each other side by side by means of an adhesive, preferably a hot melt adhesive, or by ultra-sonic welding. This further ensures size stability of the mattress spring core.

The spring pockets of each central spring strings may be aligned centre-to-centre with the spring pockets of each adjacent central spring string. The central spring strings will thereby form a perfectly rectangular shape, thereby allowing for a linear head and foot edges of the mattress spring core.

The central spring strings may comprise fewer spring pockets than the outermost spring strings, preferably each of said central spring strings comprises one spring pocket less than each of the outermost spring strings. The outermost spring strings can then be arranged in an overlap configuration with the central spring strings, ensuring the longitudinal projection of the corner spring pockets.

Preferably, the spring pockets of each outermost spring string are aligned off centre with the spring pockets of each adjacent central spring string. The outermost spring pockets can thus be fit inside a cavity formed by the distance between adjacent central spring pockets, which thereby assists in maintaining the longitudinal position of the outermost spring pockets.

The corner spring pockets may project longitudinally by at least one third of a spring pocket width, preferably said corner spring pockets project longitudinally by half of the spring pocket width. This has proven to provide effective corner filling when the mattress spring core is arranged in a mattress cover, thereby ensuring a rectangular shape of the mattress with well-defined corners.

The plurality of spring pockets may have the same width or diameter. This facilitates manufacturing and production of the mattress spring core.

The mattress spring core may comprise four corner spring pockets, each projecting longitudinally from an adjacent column end spring pocket. Each corner of the rectangular mattress spring core will thus fill out the corner of an associated mattress cover.

The mattress spring core may comprise eight corner spring pockets arranged in pairs, wherein each pair of spring pockets project longitudinally from an adjacent column end spring pocket. Hence, each corner of the mattress spring core will have two corner spring pockets.

The mattress spring core may comprise one or more layers of spring pockets, preferably one or two layers of spring pockets. It is thus possible to produce mattress spring cores of different properties and behaviour, still benefiting of shape stability and well-defined corners.

A fabric material of the spring pocket may be a nonwoven fabric material comprising thermoplastic material.

A spring constant of the spring of the corner spring pocket may be higher than a spring constant of the spring of the adjacent column end spring pocket.

According to one aspect, a mattress is provided. The mattress comprises the mattress spring core according to any of the aspect described above, and a mattress cover enclosing said mattress spring core.

According to a further aspect, a method for manufacturing a mattress spring core is provided. The method comprises the steps of the method according to the third aspect described above, as well as a step of providing a plurality of spring pockets arranged in longitudinal columns and transverse rows, and a step of arranging at least one corner spring pocket such that it projects longitudinally from an adjacent column end spring pocket.

Further objects and advantages of the present invention will be obvious to a person skilled in the art when reading the detailed description below of different embodiments.

BRIEF DESCRIPTION OF THE DRAWINGS

By way of example, embodiments of the present invention will now be described with reference to the accompanying drawings, in which.

DETAILED DESCRIPTION OF THE INVENTION

The invention relates to a mattress spring core, a method of producing such mattress spring core and to a mattress comprising the mattress spring core.

In the following a mattress spring core 1 will be described. As used in this description the expression "longitudinal" refers to the direction of the length of the mattress, i.e. the normal feet-to-head direction of a person lying on the mattress comprising the mattress spring core 1. The expression "transversal" refers to the direction of the width of the mattress spring core 1. The longitudinal and transversal directions are at right angles to each other. The mattress spring core has normally a rectangular form as seen from above. Thus, the length of the mattress spring core corresponds to the longer sides of the rectangle (i.e. in the longitudinal direction) and the width of the mattress spring core corresponds to the shorter sides of the rectangle (i.e. the transversal direction). It is for instance common to have single-bed mattresses with a length of 200 cm and a width of 90 cm. The terms "upper" and "lower" are used to define the normal position of the mattress spring core 1, i.e. having an upper side onto which the person using the mattress is intended to rest upon, and a lower side forming the underside of the mattress during normal use.

Figure 1:
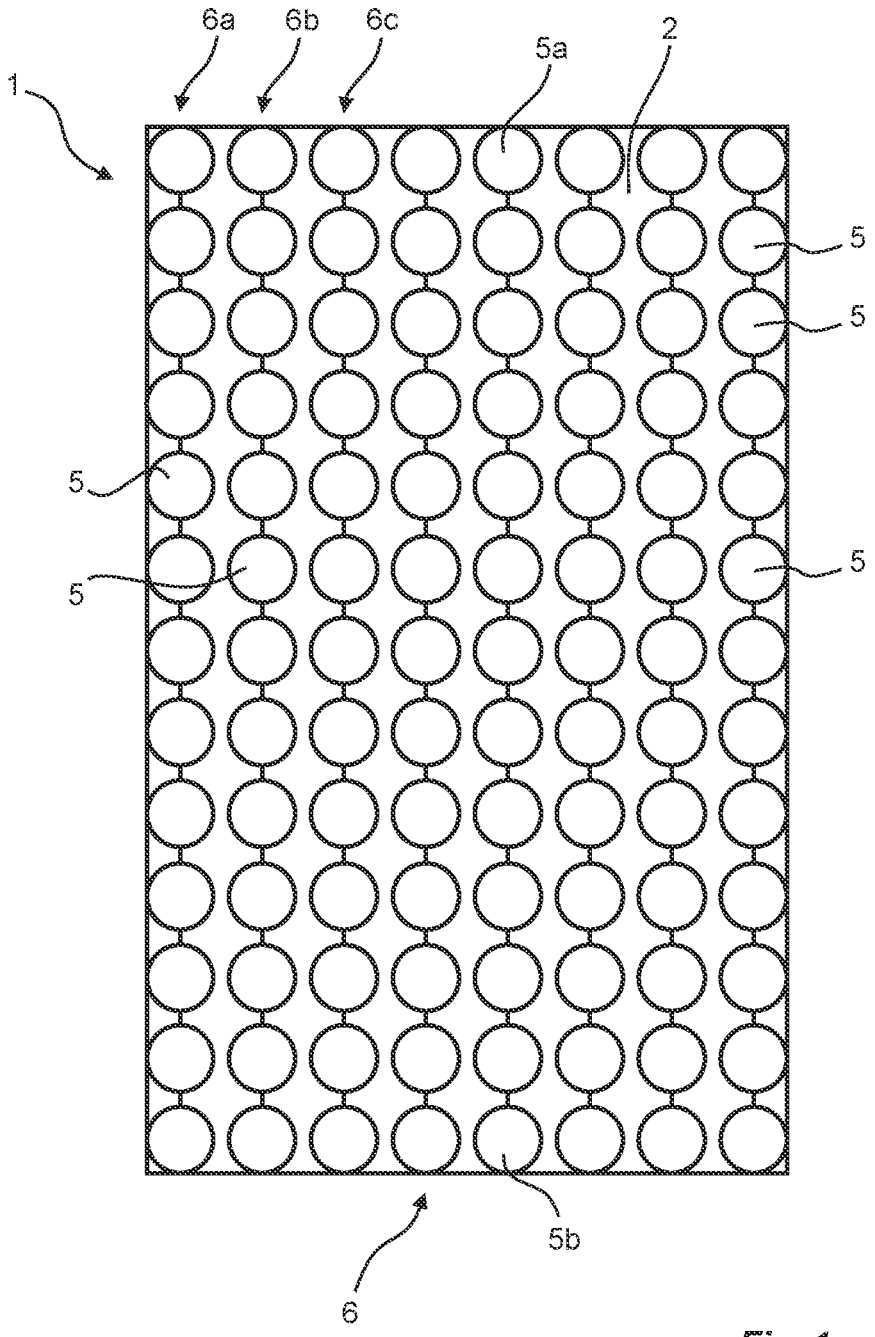
FIG. 1 is a top view of a mattress spring core.

FIG. 1 illustrates an embodiment of mattress spring core 1 according to the invention. As is seen in FIG. 1, the mattress spring core 1 comprises a number of spring core units 5 which are arranged on a sheet 2. Each spring core unit 5 has at least one coil spring (see FIG. 2) in a pocket made of fabric. The spring core units 5 are arranged in longitudinal strings 6 and these strings 6 are attached to the sheet 2 side by side such that they together form a rectangular shaped mattress spring core 1. The sheet 2 is configured to stabilize the shape of the mattress spring core 1 by preventing spring core units 5 of a first string 6*b* to move, or to become displaced relative the spring core units 5 of an adjacent string 6*a*, 6*c*.

As explained in the background section, it is common to apply one or more metal frames around the mattress spring core 1 to make its shape stable. However, when the shape of the spring core 1 is stabilized by the sheet 2, the stabilizing effect of the metal frame is not needed why the metal frame can be omitted. An effect of this is that the mattress spring core 1, and later a mattress 20 (see FIG. 3) comprising the spring core 1, can be packed by vacuum pressing and roll-up for space savings and easier transports. It is also common to arrange the spring core units 5 side by side with no or very small space between spring core units 5 of adjacent strings 6, such that each spring core unit 5 forms a support for its neighboring spring core units 5 to stabilize the rectangular shape of the mattress spring core 1. However, with the present invention, corresponding stabilizing effect may be achieved even with larger spaces between adjacent spring core units 5. Thereby, the total number of spring core units 5 required per mattress spring core 1 is reduced, which consequently reduces the material needed and the cost for producing a mattress.

To accomplish the stabilizing effect of the sheet 2, the sheet 2 may be made of a non-woven fabric. In a preferred embodiment, the sheet 2 is made of felt. The sheet 2 may be made of a polymer, such as e.g. polyester.

In one embodiment, the sheet 2 is made of felt comprising polyester and has a material density of between 300 and 1000 g/m$^2$. Preferably the density is in the range of 600 g/m2±20%.

The sheet 2 is essentially non-stretchable. One way of measuring how stretchable the sheet 2 is may be by way of measuring its tensile strength. The sheet 2 may have different tensile strengths in the longitudinal direction and in the transverse direction. In one embodiment, the tensile strength of the sheet 2 in the longitudinal direction, which is the machine direction during manufacturing of the sheet 2, is at least 700 N and preferably at least 850 N as defined by ISO 9073-18:2008.

In one embodiment, the tensile strength of the sheet 2 in the transverse direction, which is the cross direction during manufacturing of the sheet 2, is at least 900 N and preferably at least 1100 N as defined by ISO 9073-18:2008.

The sheet 2 may have a thickness of 2 to 6 mm, preferably 4 mm±1 mm.

For a final mattress 20 (see FIG. 3), the sheet 2 may be produced having the following properties:

- Non woven type: PET staple with 20%-25% Bi component
- Density: 500 grams/m2 (±20%)
- Thickness: 4 mm (−1/+1)
- Tensile Strength in Machine Direction (ISO 9073-18: 2008): ≥2850 N
- Tensile Strength in Cross Direction (ISO 9073-18:2008): ≥21100 N
- Elongation in Machine Direction (ISO 9073-18: 2008): min 70%
- Elongation in Cross Direction (ISO 9073-18:2008): min 70%
- Bending length in machine direction (ISO 9073:7): 160 mm (±10 mm)
- Bending length in cross direction (ISO 9073:7): 160 mm (±10 mm)
- Bending length in diagonal direction (ISO 9073:7): 160 mm (±10 mm)
- Flexural rigidity in machine direction (ISO 9073:7): 2400 mNcm (±30%)
- Flexural rigidity in machine direction (ISO 9073:7): 2400 mNcm (±30%)
- Flexural rigidity in machine direction (ISO 9073:7): 2400 mNcm (±30%)
- Resistance to Mechanical penetration (ISO 9073:5:2008): min 1500

The spring strings 6 may be attached to the sheet 2 by means of an adhesive such as e.g. hot melt adhesive. Other adhesives are also feasible. Optionally, other means of attaching the spring strings to the sheet may be used, e.g. fastening means such as e.g. staples, seams, or similar.

There are different ways to attach the spring core units 5 to the sheet 2. In one embodiment, each spring core unit 5 of a string 6 is attached to the sheet 2. Optionally, only one or a few spring core units 5 of a string 6 is/are attached to the sheet 2. In one embodiment, only two spring core units 5 of a string 6 are attached to the sheet 2. This may be advantageous when the spring strings 6 have a longitudinal extension such that they define the length of the mattress spring core 1, i.e. each spring string 6 may extend the full length of the mattress spring core 1. One option, in such cases, is to only attach the first 5*a* and the last 5*b* spring core units 5 to the sheet 2.

Figure 2:
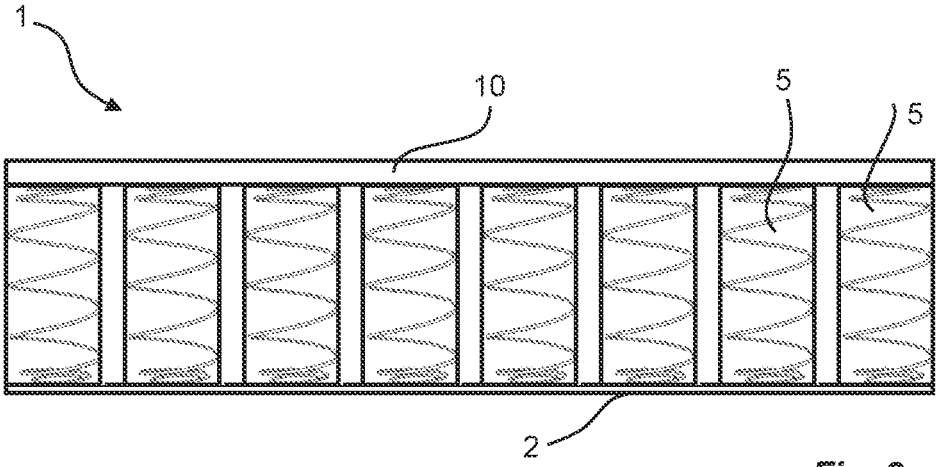
FIG. 2 is a side view of a cross section of a mattress spring core.

Turning now to FIG. 2, which is a cross sectional view taken from the side of a part of a mattress spring core 1 according to the invention. The mattress spring core 1 has a number of spring core units 5 arranged on a sheet 2 as described already in relation to FIG. 1. The mattress spring core 1 further has a foam cover 10 arranged on top of the spring core units 5 such that the spring core units 5 are arranged in between the sheet 2 and the foam cover 10. The foam cover 10 further stabilizes the rectangular shape of the mattress spring core 1. While many different materials and dimensions for the foam cover 10 may be considered, in one embodiment the foam cover 10 is made of polyurethane foam at a density of 20-30 kg/m3. The thickness of the foam cover 10 may be in the range of 1-25 cm, such as in the range of 3-10 cm.

Preferably, the sheet 2 and the foam cover 10 have the same rectangular dimensions although the foam cover 10 may be significantly thicker than the sheet 2.

Figure 3:
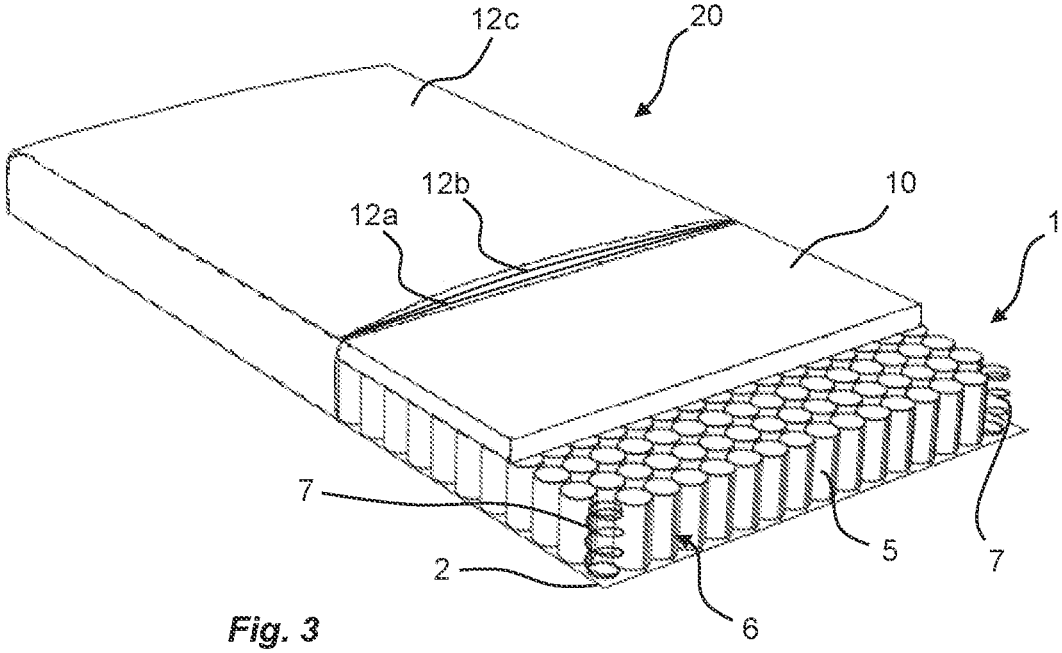
FIG. 3 is an isometric view, partly cross-sectional, of a mattress comprising a mattress spring core.

FIG. 3 illustrates a mattress 20 according to the invention. The mattress 20 has a mattress spring core 1 with a plurality of spring core units 5 arranged on a sheet 2, where the spring core units 5 are arranged in longitudinal strings 6 which are attached to the sheet 2 according to any of the embodiments described in relation to FIG. 1.

It should be noted that in FIG. 3, the two front most edge spring core units 5 are shown without their fabric pocket, to illustrate the general shape of the metal springs 7 contained within a single spring core unit 5. As can be seen, the metal springs 7 are barrel shaped although other shapes may also be possible.

The mattress 20 may further have a foam cover 10 arranged on top of the spring core units 5, as described in relation to FIG. 2. The mattress 20 may further have additional layers 12 such as linings 12*a*, waddings 12*b*, and tickings 12*c*, as is well known in the art.

Figure 4:
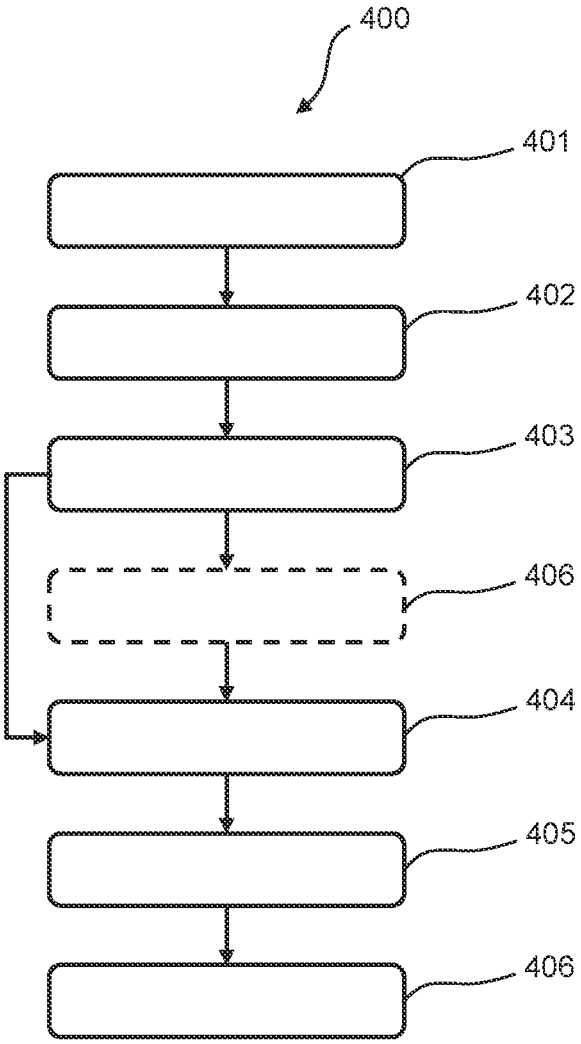
FIG. 4 is a schematic outline of a method for producing a mattress spring core.

In the following, a method for producing a mattress spring core will be described. A flowchart of the method is illustrated in FIG. 4. The method 400 comprises providing 401 a sheet 2, providing 402 a plurality of spring core units 5 arranged in longitudinal strings 6, and attaching 403 the strings 6 to the sheet 2 side by side to form a rectangular shaped mattress spring core 1. The sheet 2 is configured to stabilize the rectangular shape of the mattress spring core 1 by preventing the spring core units 5 of a first string 6 to be displaced relative the spring core units 5 of an adjacent string 6, as described in relation to the embodiments of the mattress spring core 1 disclosed herein.

The step 401 of providing the sheet 2 may be performed by manufacturing a felt-like material, and cutting the felt-like material to a sheet 2 having a rectangular shape to fit with the desired shape of the mattress spring core 1. During manufacturing of the felt-like material some specific properties may be obtained, relating to thickness, tensile strength, density, elasticity, etc. as has been explained above.

The step 402 of providing a plurality of spring core units 5 may be performed by operating a coiled spring machine, feeding the machine with one or more metal wires as well as a fabric material, and producing the springs 7 from the metal wire and simultaneously arranging the springs 7 in respective fabric pockets. As this is performed in an automatic process, the machine will produce spring core units 5 distributed in longitudinal strings 6, said strings 6 having a length corresponding to the length or width of the mattress spring core 1 depending on the desired orientation of the strings 6 within the mattress spring core 1.

Attaching 403 the spring strings 6 may comprise attaching 403 the spring strings 6 to the sheet 2 by means of an adhesive such as e.g. hot melt adhesive. Other adhesives or fastening means are also feasible, as described above.

In one embodiment, attaching 403 the spring strings 6 to the sheet 2 comprises attaching 403 each spring core unit 5 of a string 6 to the sheet. Optionally, to speed up this step in the production, one or a few spring core units 5 of a string 6 is/are attached to the sheet 2. In one embodiment, the step of attaching 403 comprises attaching 403 only two spring core units 5 of a string 6 to the sheet 2, such as the first 5*a* and the last 5*b* spring core units 5. This may be advantageous when the spring strings 6 have a longitudinal extension such that they define the length of the mattress spring core 1, i.e. each spring string 6 may extend the full length of the mattress spring core 1, as previously described.

The method 400 may further comprise arranging 404 a foam cover 10 on top of the spring core units 5 such that the spring core units 5 are arranged in between the sheet 2 and the foam cover 10. The foam cover 10 will further stabilize the rectangular shape of the mattress spring core 1.

In a final manufacturing step 405, the mattress spring core 1 may be assembled to a final mattress 20 by providing additional layers (i.e. lining, wadding, and ticking).

Yet further, the method 400 may be performed by an additional step 406 in which the mattress 20 is vacuum packed and optionally rolled up and wrapped such that a very compact and space-reducing packaging is obtained. Once unpacked, the mattress 20 will return to its desired and planar shape while the sheet 2 ensures correct positioning of the strings 6. Optionally, step 406 may be performed prior to step 405 and possibly also prior to step 404, such that vacuum packing and optional roll-up is performed directly on the mattress spring core 1. In such embodiment the advantages of the sheet 2 are even more evident, as there is no ticking or other additional layers or foam cover 10 to assist in maintaining the desired rectangular shape of the mattress spring core 1.

Now turning to FIGS. 5-9, embodiments will be described where the mattress spring core 1 described above with reference to FIGS. 1-4 is further provided with longitudinally projecting corner spring pockets. Hence, the description below requires the common technical concept of a mattress spring core 1 comprising a sheet 2 and a plurality of spring core units 5 arranged on the sheet 2, wherein the spring core units 5 are arranged in longitudinal strings 6, 6*a*, 6*b*, 6*c*, said strings 6, 6*a*, 6*b*, 6*c* being attached to the sheet 2 side by side to form a rectangular shaped mattress spring core 1, and wherein the sheet 2 is configured to stabilize the rectangular shape of the mattress spring core by preventing the spring core units 5 of a first string 6, 6*a*, 6*b*, 6*c* to be displaced relative the spring core units 5 of an adjacent string 6, 6*a*, 6*b*, 6*c*.

Figure 5A:
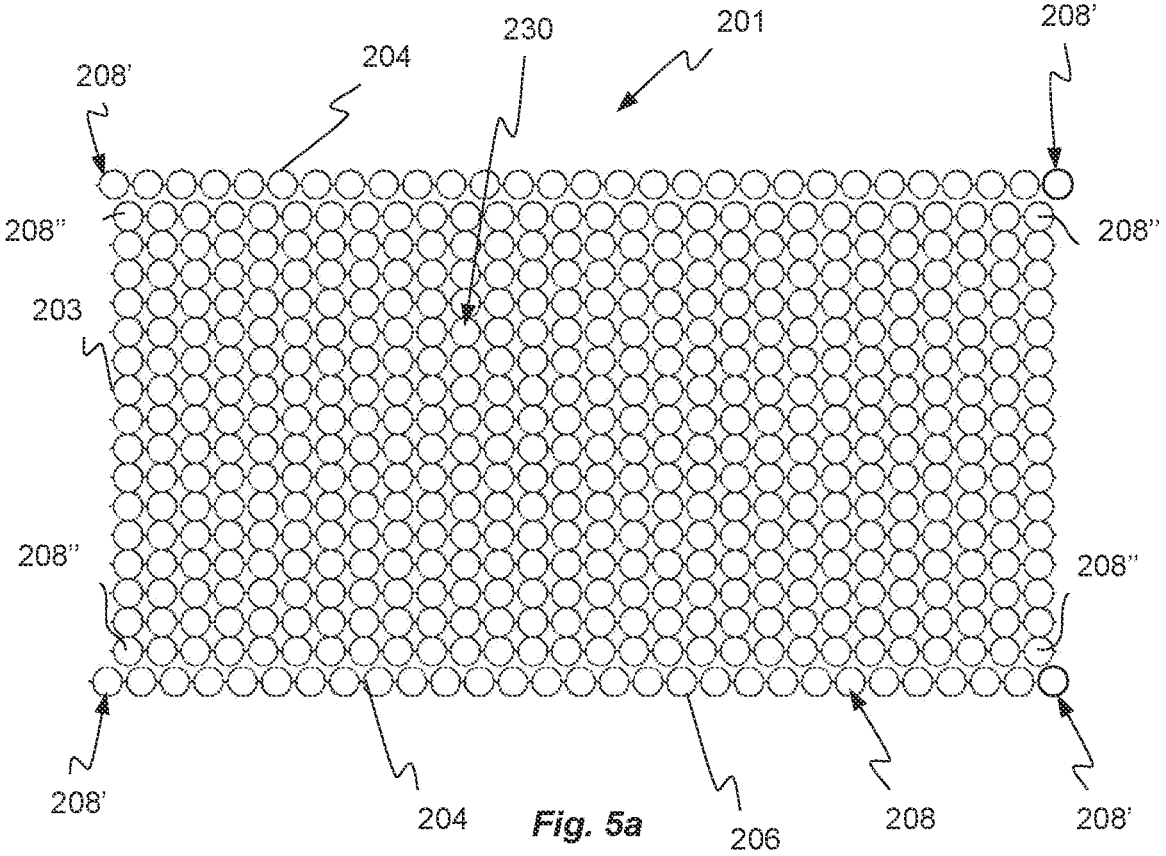
FIG. 5*a* is a top view of the mattress spring core according to one embodiment.

FIG. 5*a* shows a mattress spring core 201 as seen from above. The mattress spring core 201 comprises a plurality of spring pockets 208 arranged in longitudinal columns and transverse rows. The spring pockets 208 are preferably distributed in a plurality of longitudinally extending spring strings 203, 204.

The spring strings 203, 204 are arranged side by side, which together form the mattress spring core 201. The spring strings 203, 204 are central spring strings 203 or outermost spring strings 204. The two outermost spring strings 204 are arranged along the outer longitudinal edge of the mattress spring core 201, on an external side of the last central spring strings 203. The outermost spring strings 204 are in direct contact, or immediately next to, the central spring strings 203.

Figure 5B:
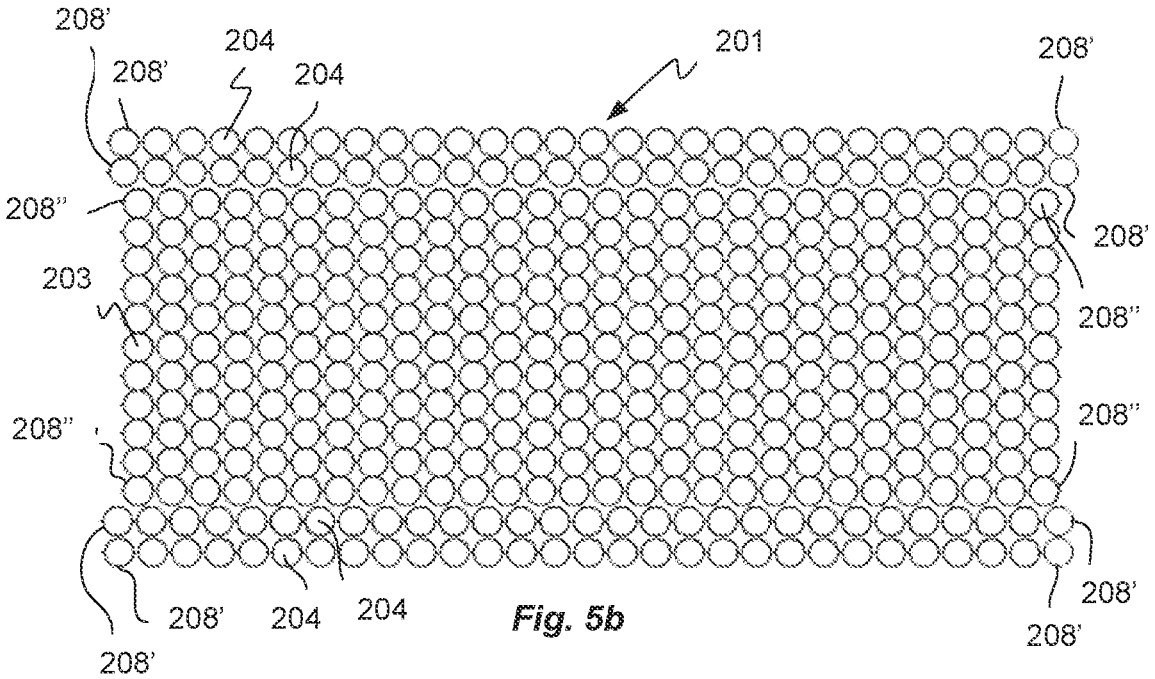
FIG. 5*b* is a top view of a mattress spring core according to another embodiment.

As can be seen in FIG. 5*b*, another embodiment of a mattress spring core 201 is shown where two outermost spring strings 204 are arranged on each side of the central spring strings 203. Also in this embodiment the inner ones of the outermost spring strings 204 are in direct contact, or immediately next to, the central spring strings 203.

Figure 7:
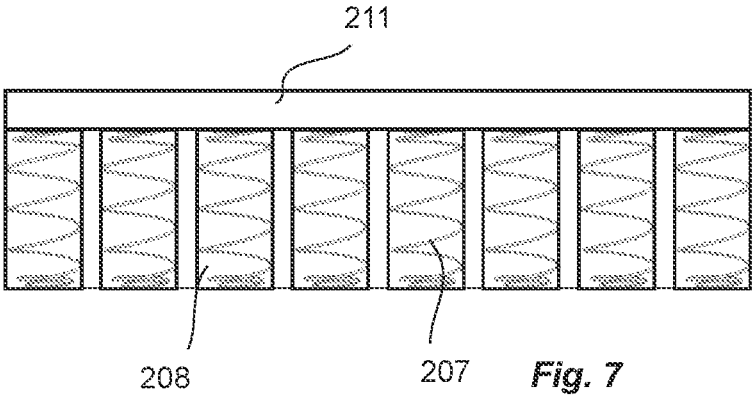
FIG. 7 is a cross-sectional view of a plurality of spring pockets of a spring string.

Referring to both FIG. 5*a* and FIG. 5*b*, each spring string 203, 204 comprises a fabric material 206 forming pockets or cavities configured to hold springs 207 (see FIG. 7). Hence, a spring pocket 208 comprises a spring 207 and a fabric material 206 enclosing the spring 207. The fabric material 206 may e.g. be a nonwoven fabric material, preferably a material comprising thermoplastic material or another material which is suitable for ultrasonic welding or friction welding. The springs 207 are preferably coil springs (as shown in FIG. 7), but other spring types are also conceivable.

In the embodiment of FIG. 5*a* the mattress spring core 201 comprises four corner spring pockets 208'. In the embodiment of FIG. 5*b* the mattress spring core 201 comprises eight corner spring pockets 208'.

These corner spring pockets 208' are the end spring pockets of the outermost spring strings 204. The last central spring strings 203 have end spring pockets 208", arranged adjacent to the corner spring pockets 208". As will be explained further in the following, the corner spring pockets 208' project longitudinally relative the adjacent end spring pockets 208".

Figure 6:
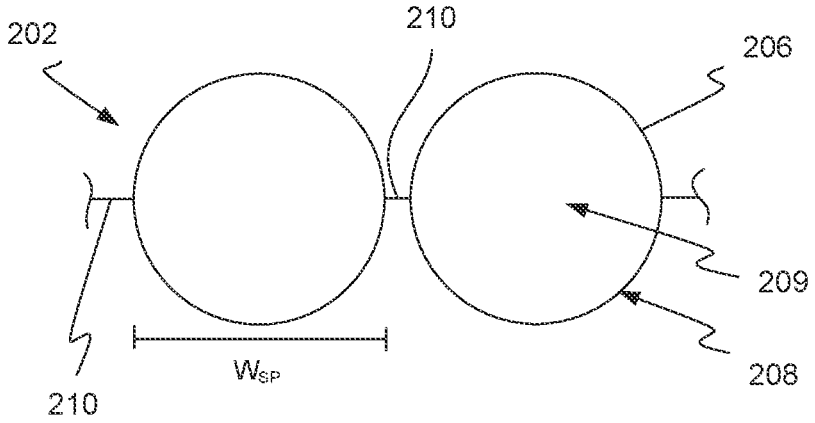
FIG. 6 is an enlarged portion of a portion of a spring string comprised in said mattress spring core.

With reference to FIG. 6, an enlarged portion of a spring string 203, 204 is shown. The spring pockets 208 are made from the fabric material 206, and are separated from each other by a welded edge seam 210, formed when manufacturing the spring pockets 208. The portion of the spring string 202 in FIG. 6 comprises two spring pockets 208, each having a diameter or width $W_{SP}$.

As shown in FIG. 5*a* and FIG. 5*b* each central spring string 203 is arranged as an array of spring pockets 208, where the central spring strings 203 are aligned in both the transversal and the longitudinal direction such that adjacent spring pockets 208 are aligned centre-to-centre. Together, the central spring springs 203 are connected to each other form a central part 230 of the mattress spring core 201. The central part 230 has a rectangular shape. However, in other embodiments of the disclosed mattress spring core 1, the central part 230 may have a square or more elongate shape than shown in FIG. 5*a* and FIG. 5*b*.

As opposed to the central spring strings 203, the outermost spring strings 204 are not centre-to-centre aligned with respect to the central spring strings 203. This achieves protruding corners on the mattress spring core 201 by means of the corner spring pockets 208'.

The outermost spring strings 204 in FIG. 5*a* and FIG. 5*b* are all arranged offset in the longitudinal direction with respect to the central spring strings 203. The displacement of the outermost spring strings 204 is about half a spring pocket 208, i.e. half a width $W_{SP}$ of the spring pocket 208. Therefore, as shown in FIG. 5*a* and FIG. 5*b*, each corner spring pocket 208' project by approximately a half spring pocket width $W_{SP}$ from the short, or longitudinal end of the central part 230 of the mattress spring core 201. Hence, the outer spring strings 204 comprise one additional spring pocket 208 compared to the central spring strings 203.

The arrangement of the outer spring strings 204 as described above creates additional material at the corners and thus minimizes the space which otherwise may exist between the corners of the mattress spring core 201 and an internal corners of a mattress cover. Therefore, the problem of collapsing mattress corners is mitigated and prevented. A size and shape stable mattress spring core 201 is achieved by the addition of one extra half spring in each corner of the mattress spring core 201.

Furthermore, the concept of using longer and offset outermost spring strings 204 as disclosed herein enables an automated production, since the outermost spring strings 4 may be manufactured in the same way and by the same materials as the central spring strings 3.

Moreover, the mattress spring core 201 disclosed herein provides a more sustainable solution against collapsing mattress corners, since less and/or more sustainable materials are used compared to the use of a supporting metal rail or the use of stuffed polyurethane foam glued to the spring coil, which are common methods used in the art today.

In addition, the solution presented herein provides a less labour intense manufacturing process, since the solution enables a lean and automated production. The mattress spring core 201 comprising the outermost spring strings 204 with corner edge spring pockets 208' is formed directly during the production of the mattress spring core 201 as such.

Further, the mattress spring core 201 may be produced with varying sizes since the reinforcement for the mattress corners merely comprises displacement of the outermost spring strings 204 in relation to the central spring strings 203. A metal rail frame embedding the edges of a mattress spring core, on the other hand, would need to be manufactured specifically for each mattress size.

A further effect of the mattress spring core 201 as disclosed herein, is that the mattress spring core 201, and later a mattress 220 (see FIG. 8) comprising the mattress spring core 201, can be packed by vacuum pressing and roll-up for space savings and easier transports.

Also, the stiffness and/or softness and zones of different stiffness/softness of the mattress spring core 201 can easily be adjusted during the manufacturing process since the resilience of the springs 207 within a central or outermost spring string 203, 204 may be altered during manufacturing, or the resilience of the strings 207 in the central spring strings 203 and the outermost spring strings 204 can be different. Alternatively, the central part 230 is formed by central spring strings 203 having springs 207 of various resilience. Optionally, the diameter of the spring pockets 208 may vary between the outermost spring strings 204 and the central spring strings 203, such that the width $W_{SP}$ of the spring pockets 208 of the central spring strings 203 is smaller than the width $W_{SP}$ of the spring pockets 208 of the outermost spring strings 204, or such that the width $W_{SP}$ of the spring pockets 208 of the outermost spring strings 204 is smaller than the width $W_{SP}$ of the spring pockets 208 of the central spring strings 203.

In FIG. 5*a* and FIG. 5*b*, a spring string 203, 204 forms one column of the mattress spring core 201. The spring strings 203, 204 have a longitudinal extension along the length of the mattress spring core 201. In other embodiments, the spring strings 203, 204 may be arranged in a transverse direction, extending along the short or longitudinal sides of the mattress spring core 201.

The spring strings 203, 204 may be attached to each other by means of an adhesive, such as a hot melt adhesive, by sewing, or by stapling. Other adhesives are also feasible, as well as other feasible fastening techniques known in the art.

Further, the spring constant of the springs 207 may vary and the mattress spring core 201 may comprise reference springs and stiffer springs compared to reference springs comprised in the mattress spring core 201. For instance, the stiffer springs have a spring constant in the range of 15% to 30%, more specifically 20% to 25%, and preferably approximately 25% higher than the reference springs. In addition, the diameter of the springs 207 can be of varying size.

An increased spring constant can be achieved for instance by increasing the wire gauge of the springs 207. An exemplary diameter for stiffer frame springs may be approximately 1.9 mm whilst reference springs may have a diameter of approximately 1.7 mm.

Alternatively, an increase in spring constant of the springs 207 could be achieved by removing one convolution on each of the springs 207. The exact use of stiffer springs can of course be varied; in one embodiment each of the outermost spring strings 204 comprises stiffer springs 207 than the central spring strings 203. Optionally, the corner spring pockets 208' are enclosing stiffer springs 207 than the remaining spring pockets 208 of the mattress spring core 201.

In FIG. 5*a* and FIG. 5*b*, the mattress spring core 1 is comprised of a monolayer of spring strings 203, 204. It is to be realized that combinations of several layers of spring strings 203, 204, such as two, three or four layers, are also feasible to form a mattress spring core 201. In such case, additional combinations of springs 207 having varying stiffness and/or diameter is possible. For instance, when combining two layers of spring strings 202, three outermost rows can be made of stiffer frame springs in the upper and/or the lower layer along the longitudinal edges of the mattress spring core 201 and two outermost rows of stiffer frame springs in the upper and/or the lower layer along the transversal edges.

Each spring string 203, 204 may comprise between 8 and 30, such as between 12 and 16 spring pockets 208 per meter. In one particular embodiment each spring string 203, 204 comprises 25 spring pockets 208 per two meters, i.e. 12.5 spring pockets 208 per meter. A mattress spring core 201 of a typical length of 200 cm may for example comprise between 16 and 60, preferably between 20 and 32 spring pockets 208 in the longitudinal direction. Hence, if the spring strings 202 are arranged in a transverse direction, along the short edge of the mattress spring core 201, each spring string 203, 204 comprises fewer spring pockets 208 than when the spring strings 203, 204 are arranged along the length of the mattress spring core 201.

Each spring string 203, 204 is attached by means of an adhesive, preferably hot melt adhesive, side by side to another spring string 203, 204. Between 10 to 25 spring strings 203, 204, preferably approximately 13 to 15 spring strings 203, 204 (as shown in FIG. 5*a*) together form a mattress spring core 201 with a width of 90 cm. However, fewer or more spring strings 203, 204 may be used to decrease or increase the width of the mattress spring core 201, or to decrease or increase the length of the mattress spring core 201 if the spring strings 203, 204 are arranged along the width of the mattress spring core 201 (as opposed to the extension direction of the spring strings 203, 204 shown in FIG. 5*a* and FIG. 5*b*).

In FIG. 7 a cross-sectional view taken from the side of a part of a mattress spring core 201 is shown. The mattress spring core 201 has a number of spring pockets 208 enclosing respective springs 207. Although shown as barrel-shaped, the springs 207 may have other configurations. The mattress spring core 201 further has a foam cover 211 arranged on top of the spring pockets 208. The foam cover 211 further stabilizes the rectangular shape of the mattress spring core 201. While many different materials and dimensions for the foam cover 211 may be considered, in one embodiment the foam cover 211 is made of polyurethane foam at a density of 20-30 kg/m3. The thickness of the foam cover 211 may be in the range of 1-25 cm, such as in the range of 3-10 cm.

Figure 8:
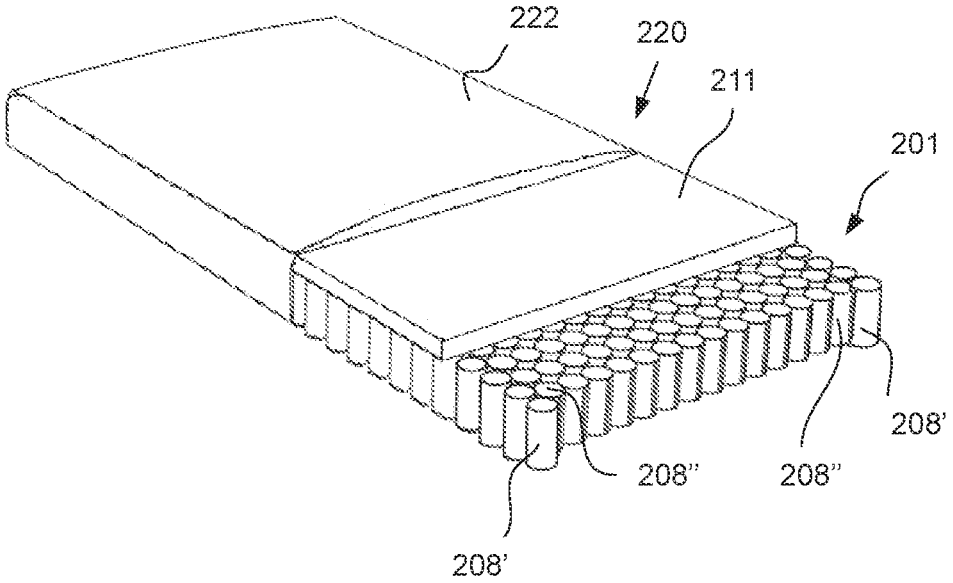
FIG. 8 is a perspective view of a mattress, including a mattress spring core according to one embodiment.

Now turning to FIG. 8, a mattress 220 is shown. The mattress 220 comprises a mattress spring core 201, a foam cover 211, and a mattress cover 222. The mattress cover 222 may e.g. comprise waddings, linings, and tickings, as is well known in the art. Preferably, the mattress cover 222 is robust enough to maintain the size and shape of the mattress spring core 201. It should be noted that the foam cover 211, as well has the mattress cover 222, has been cropped. For a final mattress 220, the foam cover 211 and the mattress cover 222 will cover the entire mattress spring core 201. As has been explained above, the protruding corner spring pockets 208' of the mattress spring core 201 will fill the interior corners of the mattress cover 222 such that the entire mattress 220 will exhibit a rectangular shape with well-defined corners. For the sake of completeness, also the adjacent end spring pockets 208" are indicated in FIG. 8.

Figure 9:
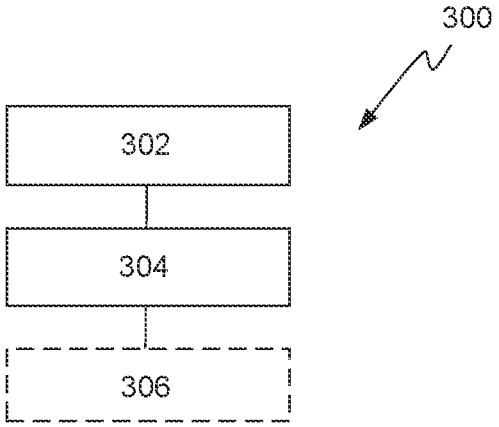
FIG. 9 is a flowchart showing a method of producing a mattress spring pocket.

A method 300 for manufacturing a mattress spring core 201 is schematically shown in FIG. 9. The method 300 may comprise a step 302 of providing a plurality of spring pockets 208 arranged in longitudinal columns and transverse rows, and a step 304 of arranging at least one corner spring pocket 208' such that it projects longitudinally from an adjacent column end spring pocket 208". The method 300 may further comprise an additional step 306 of arranging the mattress spring core 201 in a mattress cover 222, thereby extending the scope of the method 300 to actually produce a mattress 220.

The spring strings 203, 204 (both the central spring strings 203 and the outermost spring strings 204) may be manufactured according to the following. Each spring 207 is manufactured from a metal wire. Each spring 207 is positioned in a spring pocket 208 made of a fabric material 206 whereafter the spring pockets 208 are sealed, preferably by means of welding.

If the mattress spring core 201 comprises double layers of spring strings simultaneous manufacturing of the springs 207 for an upper layer and a lower layer may be performed, while enabling the alternation of two separate wires with different characteristics for each of the layers of the spring string 203, 204. Each spring string 203, 204 can be varied in a large number of ways. For instance, stiffer springs may be placed in the upper layer, the lower layer or in both layers.

To form the mattress spring core 201 the spring strings 203, 204 are preferably cut when a sufficient number of spring pockets 208 are formed, for instance around 25 spring pockets 208 for a typical mattress length of 200 cm.

Further, each spring string 203, 204 is attached side by side to another spring string 203, 204 by means of an adhesive, such as a hot melt adhesive.

It is also to be realized that the spring pockets 208 may be partially or completely formed before and/or after the springs 207 are positioned therein. A spring pocket 208 is usually formed by folding an elongate piece of fabric material 206 along its length, and welding the folded fabric material 206 to form a tube. A plurality of springs 207 are arranged within the tube, and welds are provided between the springs. The welding is performed orthogonally with respect to the longitudinal length of the folded fabric material, such that a plurality of connected spring pockets 208 are formed.

Again referring to FIG. 9, the method 300 may be performed by an additional step 308 in which the mattress 220 is vacuum packed and optionally rolled up and wrapped such that a very compact and space-reducing packaging is obtained. Once unpacked, the mattress 220 will return to its desired and planar shape while corner spring pockets 208' ensures the rectangular shape of the mattress. Optionally, step 208 may be performed directly on the mattress spring core 201. In such embodiment the advantages of the corner spring pockets 208' are even more evident, as there is no ticking or other additional layers or foam cover to assist in maintaining the desired rectangular shape of the mattress spring core 201.

The present disclosure thus presents a mattress spring core 201 comprising a plurality of spring pockets 208 arranged in longitudinal columns and transverse rows by a plurality of parallel central spring strings of the same length and forming a rectangular central part, and by at least two outermost spring strings arranged on opposite sides of and immediately next to the central spring strings. At least one corner spring pocket 208' projects longitudinally from an adjacent column end spring pocket 208".

It should be mentioned that the inventive concept is by no means limited to the embodiments described herein, and several modifications are feasible without departing from the scope of the appended claims. In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc. do not preclude a plurality. Reference signs in the claims are provided merely as a clarifying example and shall not be construed as limiting the scope of the claims in any way.

The invention claimed is:

1. A mattress spring core comprising a sheet and a plurality of spring core units arranged on the sheet, wherein the plurality of spring core units are arranged in longitudinal strings, said strings being attached to the sheet, side by side, to form a rectangular shaped mattress spring core, wherein the sheet is configured to stabilize the rectangular shape of the mattress spring core by preventing the plurality of spring core units of a first string to be displaced relative the plurality of spring core units of an adjacent string, wherein the sheet is a non-woven fabric or made of felt, wherein a density of a material of the sheet is between 300 and 1000 g/m$^2$, and wherein the sheet has a thickness of 2-6 mm.

2. The mattress spring core according to claim 1, wherein the sheet comprises a polymer.

3. The mattress spring core according to claim 1, wherein the sheet has a tensile strength in a machine direction of at least 700 N.

4. The mattress spring core according to claim 3, wherein the sheet has a tensile strength in a cross direction of at least 900 N.

5. The mattress spring core according to claim 4, wherein the tensile strength in the cross direction is at least 1100 N.

6. The mattress spring core according to claim 3, wherein the tensile strength in the machine direction is at least 850 N.

7. The mattress spring core according to claim 1, wherein the strings are attached to the sheet by means of an adhesive or by means of one or more fasteners.

8. The mattress spring core according to claim 1, wherein at least one spring core unit of a string is attached to the sheet.

9. The mattress spring core according to claim 1, wherein each of the longitudinal strings includes a first one of the spring core units on one end of the longitudinal string and a last one of the spring core units on an opposite end of the longitudinal string, wherein the first one of the spring core units and the last one of the spring core units are attached to the sheet.

10. The mattress spring core according to claim 1, further comprising a foam cover being arranged on top of the plurality of spring core units such that the plurality of spring core units are arranged in between the sheet and the foam cover, wherein the foam cover is configured to further stabilizing the rectangular shape of the mattress spring core.

11. The mattress spring core according to claim 1, wherein the plurality of spring core units are arranged in longitudinal columns and transverse rows, with at least one corner spring pocket projecting longitudinally from an adjacent column end spring pocket.

12. A mattress comprising the mattress spring core according to claim 1.

13. The mattress spring core according to claim 1, wherein the sheet comprises polyester.

14. The mattress spring core according to claim 1, wherein the density is in a range of 600 g/m$^2$±20%.

15. The mattress spring core according to claim 1, wherein the thickness is in a range of 4 mm±1 mm.

16. A method for producing a mattress spring core, comprising:

providing a sheet, providing a plurality of spring core units arranged in longitudinal strings, and attaching said strings to the sheet, side by side, to form a rectangular shaped mattress spring core, wherein the sheet is configured to stabilize the rectangular shape of the mattress spring core by preventing the plurality of spring core units of a first string to be displaced relative the plurality of spring core units of an adjacent string, wherein the sheet is a non-woven fabric or made of felt, wherein a density of a material of the sheet is between 300 and 1000 g/m$^2$, and wherein the sheet has a thickness of 2-6 mm.

* * * * *